United States Patent [19]

Avila et al.

[11] 4,222,858

[45] Sep. 16, 1980

[54] PARTICLE SEPARATOR

[76] Inventors: Maximo L. Avila, P.O. Box 402, Plymouth, Fla. 32768; Edwin L. Cortez, P.O. Box 25, Ocoee, Fla. 32671

[21] Appl. No.: 47,006

[22] Filed: Jun. 11, 1979

[51] Int. Cl.[2] ..... B07B 4/02; B07B 7/02

[52] U.S. Cl. ..... 209/11; 209/31; 209/133; 209/139 R; 209/143

[58] Field of Search ..... 209/138, 139 R, 140, 209/141, 143, 133, 132, 21–23, 28–31, 36, 37, 250, 11, 144; 55/319, 331, 332, 337

[56] References Cited

U.S. PATENT DOCUMENTS

| | | | |
|---|---|---|---|
| 226,471 | 4/1880 | Arbuckle | 209/139 R |
| 459,570 | 9/1891 | Beynon | 209/139 R |
| 1,888,372 | 11/1932 | Bramwell | 209/139 R |
| 2,047,568 | 7/1936 | Lissman | 209/133 X |
| 2,252,581 | 8/1941 | Saint-Jacques | 209/144 |
| 2,634,821 | 4/1953 | Chipley | 55/319 |
| 2,705,074 | 3/1955 | Harvengt | 209/139 R |
| 3,925,198 | 12/1975 | Eckhoff et al. | 209/37 X |

*Primary Examiner*—Ralph J. Hill

*Attorney, Agent, or Firm*—Duckworth, Hobby, Allen & Pettis

[57] ABSTRACT

A particle separator physically separates a mixture of small and large particles and metal particles which are suspended in a stream of air into discrete groups of small particles, large particles and metal particles. The particle separator includes a chamber having a bottom and including an inverted truncated cone. The cone includes an upper skirt which forms a seal with the inner wall of the chamber and an aperture in the lower end. The cone divides the chamber into upper and lower compartments. An inlet duct extends through the wall of the chamber into the upper compartment of the chamber. A filter plate is positioned within the lower compartment of the chamber and includes a first side surface which forms a seal with the inner wall of the chamber and a second side surface which forms a seal with the wall of the cone. The structure of the filter defines an intermediate compartment in the upper portion of the lower compartment. An outlet duct extends throught the wall of the chamber into the intermediate compartment. A blower is coupled to the separator and produces a flow of air from the inlet duct through the upper compartment and through the aperture in the cone into the lower compartment, through the filter into the intermediate compartment and out through the inlet duct. A valve in the bottom of the chamber removes large particles from the chamber.

21 Claims, 8 Drawing Figures

PARTICLE SEPARATOR

BACKGROUND OF THE INVENTION

1. Field of the Invention

This invention relates to particle separators, and more particularly, to particle separators which utilize air flow in combination with gravity to physically separate particles of different size and different density.

2. Description of the Prior Art

The prior art includes a variety of particle separators for separating a granulated particle mixture into separate batches of particles of related size or related density.

U.S. Pat. No. 3,312,341 (Weinecke) discloses a flotation separator which includes an air blower for creating a vertical flow of air through a vertical duct. An aguer coupled at an angle to the vertical portion of the duct removes heavier particles from the particles blown upward by the blower. The less dense particles are discharged from the upper end of the duct. The mixed input product is introduced midway along the height of the vertical duct.

U.S. Pat. No. 1,877,861 (Hatch) discloses a particle separator having a vertically oriented chamber and includes an air discharge outlet in the lower portion thereof which creates a vertical updraft within the chamber. The lower density fines are separated out in a cyclone which is coupled to the upper end of the vertically oriented chamber. The higher density particles are discharged from the lower end of the vertically oriented chamber.

U.S. Pat. No. 3,861,059 (Lindenman) discloses a drying apparatus having a blower which establishes a flow of air through a vertically oriented chamber.

U.S. Pat. No. Re. 29,625 (Summers) discloses an apparatus which separates sand from tobacco. The separated tobacco product is separated from a stream of air passing through the separator by a cyclone separator.

Other relevant art is disclosed in the following United States patents:

U.S. Pat. No. 2,899,139 (Hardinge)
U.S. Pat. No. 3,398,829 (Brown)
U.S. Pat. No. 3,825,116 (Greenwood)
U.S. Pat. No. 3,929,628 (Denevi).

SUMMARY OF THE INVENTION

The present invention contemplates a particle separator which physically separates a mixture of small and large particles suspended in a stream of air. The particle separator comprises a chamber having a bottom and includes an inverted truncated cone having an upper skirt forming a seal with the inner wall of the chamber and an aperture in the lower end of the cone for dividing the chamber into upper and lower compartments.

An inlet duct extends through the wall of the chamber into the upper compartment of the chamber. Filter means is positioned within the lower compartment of the chamber and includes a first side surface which forms a seal with the inner wall of the chamber and a second side surface which forms a seal with the wall of the cone. The filter means defines an intermediate compartment in the upper portion of the lower compartment. An outlet duct extends through the wall of the chamber into the intermediate compartment. Blower means is coupled to the separator for producing a flow of air from the inlet duct through the upper compartment and through the aperture of the cone into the lower compartment, through the filter means and into the intermediate compartment and out through the outlet duct. Means is coupled to the bottom of the chamber for removing large particles from the chamber.

DESCRIPTION OF THE DRAWINGS

The invention is pointed out with particularity in the appended claims. However, other objects and advantages together with the operation of the invention may be better understood by reference to the following detailed description taken in connection with the following illustrations wherein:

DESCRIPTION OF THE PREFERRED EMBODIMENT

In order to better illustrate the advantages of the invention and its contribution to the art, a preferred hardware embodiment of the invention will now be described in some detail. The embodiment discussed below will be described in connection with a citrus processing plant. In this processing plant the present invention is utilized to first separate metal particles or metallic debris from a mixture of ¼ inch to 1 inch dryed, processed orange peel flakes and powdered orange peel dust. The separator of the present invention then removes the orange peel flakes from the orange peel dust.

Figure 1:
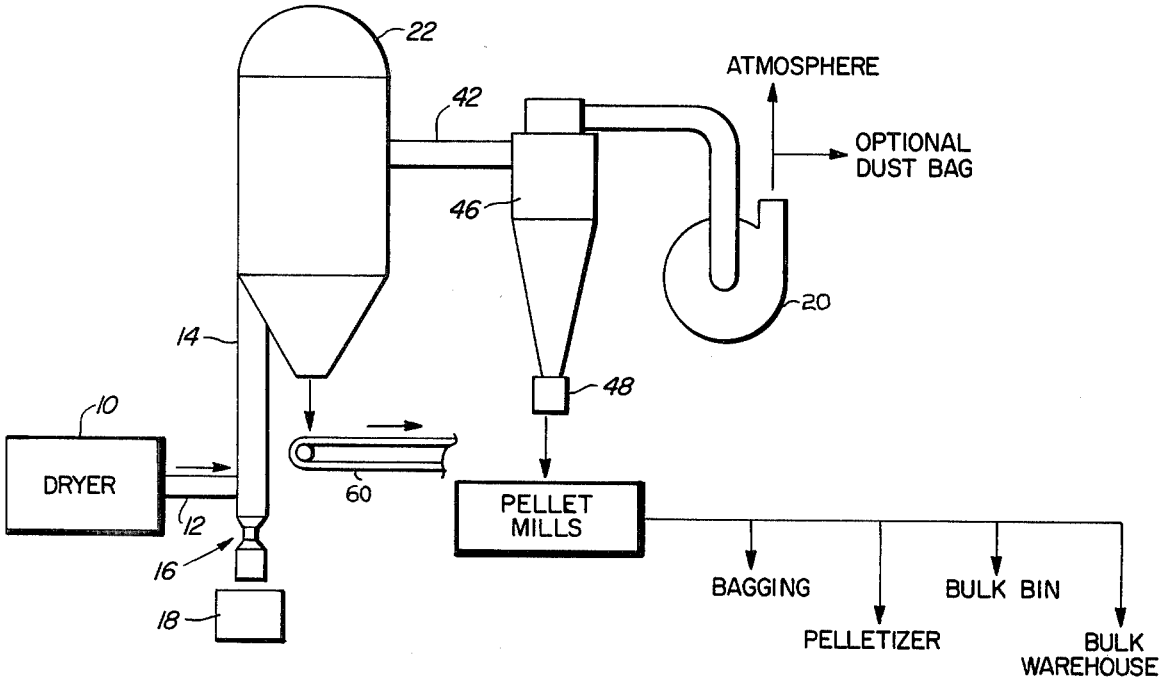
FIG. 1 is a generalized schematic diagram illustrating the installation of one embodiment of the present invention in an orange peel processing plant.

Referring now to FIG. 1, a dryer 10 heats and drys a mixture of orange peel flakes and powdered orange peel. Occassionally the materials being processed will be contaminated by metal particles from various sources and since the end product of the orange peel process may be used as animal feed, it is critical that all of these metal impurities be removed.

The output from dryer 10 is transferred through a conduit 12 into the vertically oriented inlet duct 14 of the particle separator. The lower portion of inlet duct 14 includes a venturi 16 below which is positioned a bin 18 for receiving the comparitively high density metal particles which are discharged from the incoming dryed mixture of orange peel downward through venturi 16. As can be seen from FIGS. 1 and 2, conduit 12 is coupled to the sidewall of inlet duct 14 at a point above the reduced diameter of venturi section 16 of inlet duct 14. In the preferred embodiment of the invention, the diameter of inlet duct 14 is on the order of one foot while the minimum diameter of venturi section 16 is on the order of six inches. In different applications of the present invention, the diameters of these two sections can be modified as desired in order to achieve an appropriate vertical velocity within inlet duct 14 which will suspend both the large and small diameter particles while still permitting the higher density unwanted particles to be discharged through venturi 16 into bin 18.

A forty to fifty horsepower blower 20 is coupled as shown and as will be explained below creates the desired air flow pattern within inlet duct 14 and within the interior of the particle separator of the present invention.

The main structural component of the separator of the present invention is a large chamber 22 which has a diameter of from four to nine feet in a preferred form, although larger or small diameters could be readily rendered operational with minor modifications which would be readily apparent to anyone skilled in the art.

Figure 3:
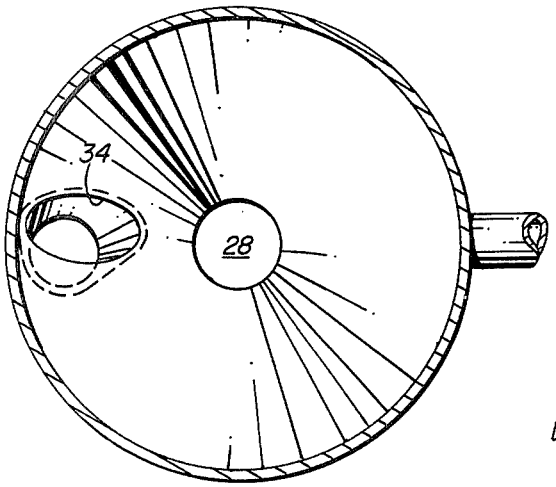
FIG. 3 is a cross-sectional view of the separator illustrated in FIG. 2, taken along section line 3—3.
Figure 4:
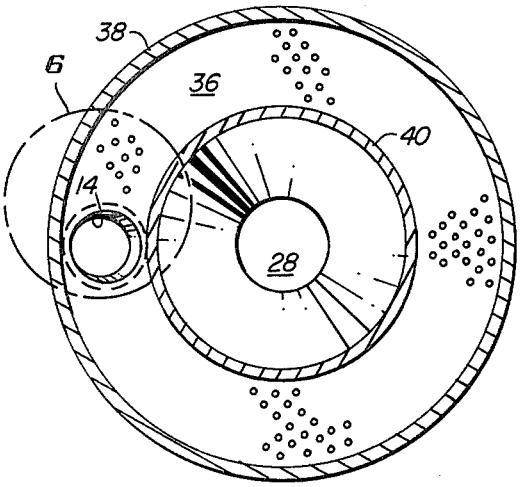
FIG. 4 is a cross sectional view of the separator illustrated in FIG. 2, taken along section line 4—4.
Figure 5:
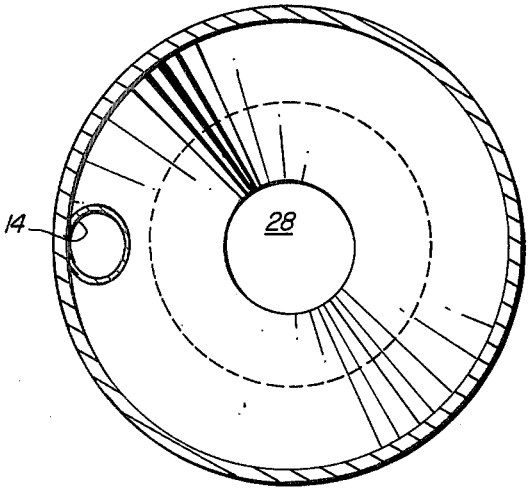
FIG. 5 is a cross-sectional view of the separator illustrated in FIG. 2, taken along section line 5—5.

Referring now also to FIGS. 3, 4 and 5, the upper portion of inlet duct 14 increases in diameter after passing through the outer wall of chamber 22. An inverted truncated cone 24 includes an upper skirt 26 which forms a seal with the inner wall of chamber 22. The lower portion of cone 24 includes an aperture 28. Cone 24 effectively divides chamber 22 into upper compartment 30 and lower compartment 32. The wall of cone 24 intersects the discharge end of inlet duct 14 at about a 45° angle along a circular intersection designated by reference number 34. The mixture of large and small orange peel particles is discharged from this opening into upper compartment 30. As can be seen the section of inlet duct 14 lying between the wall of chamber 22 and the intersection of inlet duct 14 with the wall of cone 24 angles outward to increase the particle flow distribution within upper compartment 30.

Figure 6:
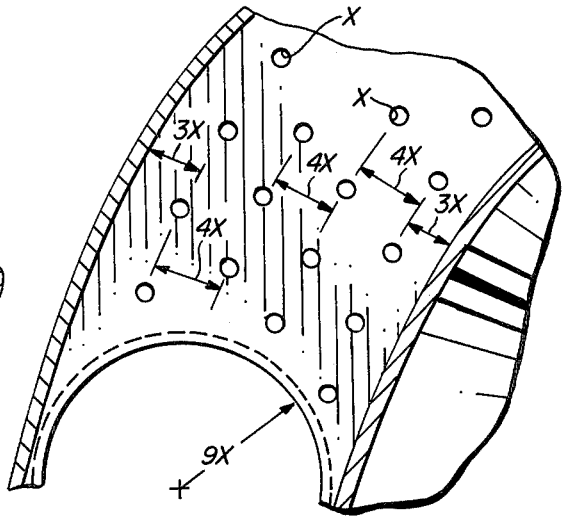
FIG. 6 is a partial sectional view of the perforated plate illustrated in FIG. 4.

Filter means in the form of a horizontally oriented donut-shaped circular plate 36 includes a plurality of perforations which are more clearly illustrated in FIGS. 4 and 6. Plate 36 is positioned within lower compartment 32 and includes a first side surface 38 which forms a seal with the inner wall of chamber 22 and a second side surface 40 which forms a seal with the wall of cone 24. FIG. 4 illustrates that inlet duct 14 passes vertically upward through an aperture in plate 36. The coupling between plate 36, the wall of cone 24 and the wall of chamber 22 defines an intermediate compartment 44 in the upper portion of lower compartment 32.

An outlet duct 42 extends through the wall of chamber 22 and into intermediate compartment 44. Blower 20 thus produces a flow of air from inlet duct 14 through upper compartment 30 and aperture 28 of cone 24 into lower compartment 32, upward through the perforations in plate 36 into intermediate compartment 44 and out through outlet duct 42. After the higher density metal particles have been discharged downward through venturi 16, the substantially equal density mixture of small and large particles travels upward through inlet duct 14 and is discharged and sprayed about the upper compartment 30 of chamber 22. Gravity and the air flow pattern established by blower 20 cause all particles within upper compartment 30 to be discharged down through aperture 28 in cone 24. The smaller particles or fines are highly effected by the flow or air within chamber 22. After passing through aperture 28 these fines are maintained in the airstream and flow through the apertures in plate 36 into intermediate chamber 14 and out through outlet duct 42. The fines then pass into cyclone separator 46 which is of a standard design well known to those skilled in the art. Cyclone separator 46 separates the fines from the flow of air and discharges the fines through discharge port 48. In a citrus processing plant these fines are then transported to pelletizing mills which prepare them for other uses.

The larger orange peel particles descend to the bottom of lower compartment 32 and accumulate on the upper surface 50 of valve 52.

Figure 2:
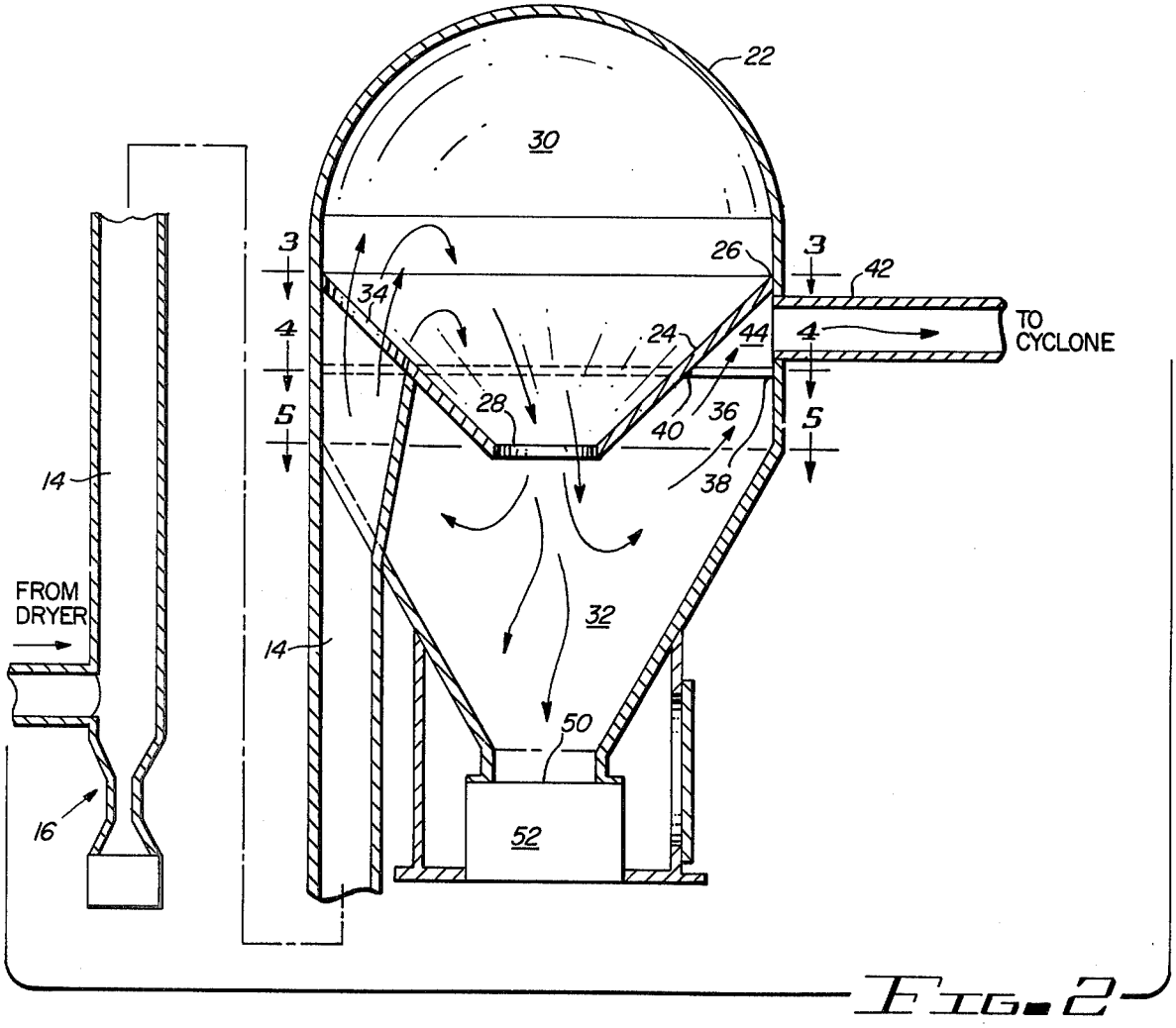
FIG. 2 is a sectional view of the separator illustrated in FIG. 1.
Figure 7:
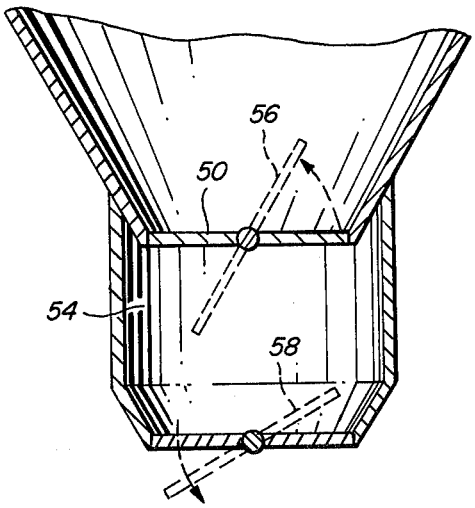
FIG. 7 is a sectional view of an air lock valve used in one embodiment of the present invention.
Figure 8:
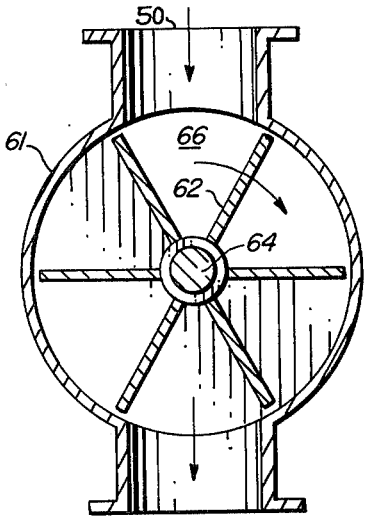
FIG. 8 is a sectional view of a rotary valve used in one embodiment of the present invention.

Referring now to FIGS. 2, 7 and 8, two different embodiments of valve 52 will be discussed. The operation of blower 20 maintains an air pressure lower than ambient within the interior of chamber 22. For this reason it is impossible to establish an opening through the exterior of chamber 22 at surface 50. FIG. 7 illustrates a discharge assembly 54 which includes an upper valve 56 and a lower valve 58. When a sufficient quantity of large particles has accumulated on the upper surface 50 discharge assembly 54, lower valve 58 is closed while upper valve 56 is opened. The large particles are thus discharged into the interior body section of discharge assembly 54. Upper valve 56 is then closed which seals off the interior body of discharge assembly 54 from the interior of chamber 22. Lower valve 58 is then opened to discharge the large particles from the separator of the present invention. A conveyor system 60 of the type illustrated in FIG. 1 may be positioned below the discharge end of valve 54 if desired.

Referring now to FIG. 8, a rotary air lock valve 61 is illustrated. A plurality of vanes, such as vane 62, are coupled about a shaft 64 and adjacent pairs of vanes serve to form individual air lock chambers around the periphery of valve 61. As deposits of large particles accumulate within a particular chamber 66 of valve 61, chamber 66 is rotated, permitting an adjacent chamber to be aligned with the upper section of the valve. Large particles are sequentially discharged from the lower section of valve 61 during and after completion of each rotation of the vanes of the valve.

The uppermost section of chamber 22 may be between 30 and 60 feet above the foundation which supports bin 18. Incorporation of the present invention in existing citrus processing plants replaces many different types of existing equipment. For instance, in existing citrus processing plants, an elevator is typically coupled to the output of dryer 10 in order to to elevate the dry, hot orange peel particles to permit further processing. Cooling devices are also incorporated downstream from the elevator to permit cooling of the orange peels discharged from dryer 10. The separator of the present invention simultaneously cools and elevates the dryed orange peel as it separates the metal particles and subsequently the large orange peel particles from the orange peel fines.

It will be apparent to those skilled in the art that the disclosed particle separator may be modified in numerous ways and may assume many embodiments other than the preferred forms specifically set out and described above. For example, the particle separator of the present invention may be used to separate many different kinds of high density particles from lower density particles, as well as subsequently separating smaller and larger particles of similar densities from each other. The use of the present invention in combination with a citrus processing plant has been described only as a single illustrative example. Similarly, numerous different structures equivalent to cone 24 may be incorporated in the present invention while serving an equivalent chamber dividing function. Accordingly, it is intended by the appended claims to cover all such modifications of the invention which fall within the true spirit scope of the invention.

I claim:

1. A particle separator for physically separating a mixture of small and large particles suspended in a stream of air comprising:

a. a chamber having a bottom and including an inverted truncated cone having an upper skirt forming a seal with the inner wall of said chamber and an aperture in the lower end of said cone for dividing said chamber into upper and lower compartments;

b. an inlet duct extending through the wall of said chamber into the upper compartment of said chamber for receiving the mixture;

c. filter means positioned within the lower compartment of said chamber and having a first side surface forming a seal with the inner wall of said chamber and a second side surface forming a seal with the wall of said cone, said filter means defining an intermediate compartment in the upper portion of said lower compartment;

d. an outlet duct extending through the wall of said chamber into said intermediate compartment;

e. blower means coupled to said separator for producing a flow of air from said inlet duct through said upper compartment and through the aperture in said cone into said lower compartment, through said filter means into said intermediate compartment and out through said outlet duct; and f. means coupled to the bottom of said chamber for removing large particles from said chamber;

whereby large particles settle to the bottom of said chamber and are removed by said removing means and whereby small particles remain suspended in the flow of air, pass through said filter means and are discharged through said outlet duct.

2. The separator of claim 1 wherein the large and small particles are of approximately the same density.

3. The separator of claim 1 wherein said chamber has a circular cross section.

4. The separator of claim 3 wherein said chamber includes a vertically oriented longitudinal axis and wherein said chamber is symmetrical with respect to said longitudinal axis.

5. The separator of claim 1 wherein said filter means comprises a horizontally oriented doughnut shaped circular plate including a plurality of perforations.

6. The separator of claim 5 wherein the total cross-sectional area of said perforations in said circular plate is approximately equal to the cross-sectional area of said inlet duct.

7. The separator of claim 5 wherein said perforations include circular perforations having a diameter less than the diameter of the large particles.

8. The separator of claim 1 wherein said inlet duct is vertically oriented and extends vertically upward from the point where said inlet ducts penetrates the wall of said chamber.

9. The separator of claim 8 wherein said inlet duct extends through the wall of the lower compartment of said chamber.

10. The separator of claim 9 wherein said inlet duct extends through the interior of the intermediate compartment of said chamber.

11. The separator of claim 1 wherein said stream of air includes metal particles and wherein said inlet duct includes means for separating metal particles from said mixture of small and large particles.

12. The separator of claim 11 wherein said inlet duct extends vertically downward from the point at which it penetrates the wall of said chamber and wherein the vertically downward extending section of said inlet duct includes a venturi.

13. The separator of claim 11 wherein said blower means is coupled to said outlet duct.

14. The separator of claim 13 wherein said blower means produces a flow of air vertically upward through said venturi.

15. The separator of claim 14 wherein a particle inlet duct is coupled to said inlet duct at a point above said venturi and introduces the mixture of small and large particles and metal particles into the flow of air produced by said blower means, whereby the heavier metal particles descend downward through the venturi section of said inlet duct and are discharged therefrom and wherein the less dense small and large particles are translated upward in said inlet duct and are discharged into the upper compartment of said chamber.

16. The separator of claim 1 wherein said removing means includes an air lock valve having first and second valve openings and a body, said first and second valve openings being actuated to sequentially transfer the large particles from the bottom of said chamber into the body of said valve and said second valve opening being actuated following the closure of said first valve opening to discharge the large particles from the body of said air lock valve.

17. The separator of claim 1 wherein said valve means includes a multi-chamber rotary valve having a first opening in the upper section thereof and a second opening in the lower section thereof for transferring the large particles from the bottom of said chamber into the body of said rotary valve and out the second opening in said valve while preventing air flow between said first and second openings of said valve.

18. The separator of claim 1 wherein said small and large particles are cooled and elevated during the separating process.

19. The separator of claim 1 wherein a cyclone separator is coupled between said outlet duct and said blower means for removing the small particles from the stream of air.

20. A particle separator for physically separating a mixture of high density particles and small and large particles of lower density wherein all of said particles are suspended in a stream of air, said separator comprising:

a. a chamber having a bottom and including an inverted truncated cone having an upper skirt forming a seal with the inner wall of said chamber and an aperture in the lower end of said cone for dividing said chamber into upper and lower compartments;

b. an inlet duct extending through the wall of said chamber into the upper compartment of said chamber and extending vertically downward from said chamber and including a venturi in the vertical section of said inlet duct for permitting said high density particles to be discharged downwardly through said venturi;

c. means coupled to said inlet duct at a point above said venturi for discharging the mixture into said inlet duct;

d. filter means positioned within the lower compartment of said chamber and having a first side surface forming a seal with the inner wall of said chamber and a second side surface for forming a seal with the wall of said cone, said filter means defining an intermediate compartment in the upper portion of said lower compartment;

e. an outlet duct extending through the wall of said chamber into the wall of said intermediate compartment;

f. blower means coupled to said separator for producing a flow of air through said inlet duct, through said upper compartment and through the aperture in said cone into said lower department, through said filter means into said intermediate compartment and out through said outlet duct; and g. an air lock valve coupled to the bottom of said chamber for removing large particles from said chamber and discharging the large particles from said air lock valve while simultaneously preventing a flow of air through said valve into the lower compartment of said chamber;

whereby large particles settle to the bottom of said chamber and are removed by said air lock valve and whereby small particles remain suspended in the flow of air, pass through said filter means and are discharged through said outlet duct.

21. The separator of claim 20 further including a cyclone separator coupled between said blower means and said outlet duct for removing the small particles from the stream of air.

* * * * *